US012522993B2

(12) United States Patent
Gentle et al.

(10) Patent No.: US 12,522,993 B2
(45) Date of Patent: Jan. 13, 2026

(54) SYSTEMS AND METHODS FOR OPERATING SNOW WINGS OF MOTOR GRADERS

(71) Applicant: Caterpillar Inc., Peoria, IL (US)

(72) Inventors: Michael C. Gentle, Maroa, IL (US); Ethan M. Tevis, Bloomington, IL (US); David L. Cox, Monticello, IL (US)

(73) Assignee: Caterpillar Inc., Peoria, IL (US)

( * ) Notice: Subject to any disclaimer, the term of this patent is extended or adjusted under 35 U.S.C. 154(b) by 1062 days.

(21) Appl. No.: 17/363,632

(22) Filed: Jun. 30, 2021

(65) Prior Publication Data

US 2023/0002985 A1 Jan. 5, 2023

(51) Int. Cl.
*E01H 5/06* (2006.01)

(52) U.S. Cl.
CPC ..... *E01H 5/067* (2013.01)

(58) Field of Classification Search
CPC ..... E01H 5/067; E01H 5/061
USPC ..... 172/2
See application file for complete search history.

(56) References Cited

U.S. PATENT DOCUMENTS 1,678,113 A * 7/1928 Gustafson ..... E01H 5/06 37/231
4,282,933 A 8/1981 Suganami et al.
4,807,131 A 2/1989 Clegg
4,834,191 A * 5/1989 Vecchio ..... E02F 3/815 172/784
5,584,346 A 12/1996 Sakamoto et al.
5,819,190 A 10/1998 Nakagami et al.
5,848,654 A * 12/1998 Belcher ..... E02F 3/815 37/274
6,112,145 A * 8/2000 Zachman ..... E02F 3/845 701/50
9,227,478 B2 * 1/2016 Horstman ..... B60G 21/007
9,637,889 B2 * 5/2017 Elkins ..... E02F 3/764
10,400,425 B2 9/2019 Horstman et al.
2019/0376246 A1 12/2019 Vachon
2020/0173141 A1 * 6/2020 Gentle et al. ..... E02F 3/765
2020/0399843 A1 * 12/2020 Passmore ..... B60Q 9/008

FOREIGN PATENT DOCUMENTS

JP 4448624 B2 4/2010

* cited by examiner

*Primary Examiner* — Christopher J Sebesta
*Assistant Examiner* — Joel F. Mitchell

(57) ABSTRACT

Systems and methods for operating a grading machine. The method includes (i) receiving information regarding material on a surface, and the grading machine is configured to travel on the surface and move the material on the surface; (ii) determining a set of parameters for operating the grading machine, and the set of parameters include an articulation angle of the grading machine and a moldboard angle of a moldboard of the grading machine; and (iii) positioning a snow wing and the moldboard of the grading machine based on the set of parameters such that the snow wing has a predetermined spatial relationship with the moldboard.

19 Claims, 15 Drawing Sheets

200

SYSTEMS AND METHODS FOR OPERATING SNOW WINGS OF MOTOR GRADERS

TECHNICAL FIELD

The present technology is directed to systems and methods for operating motor graders and other suitable machines, vehicles, and devices. More particularly, systems and methods for operating snow wings of motor graders are disclosed herein such that an operator can effectively operate the motor graders.

BACKGROUND

When operating a motor grader, an operator needs to properly position its components such as a snow wing, a moldboard, a blade, etc. It is difficult for inexperienced operators (and sometimes even experienced ones) to properly position and operate the components of the motor grader so as to effectively remove material/objects (e.g., snow) from a road surface. Multiple operating factors or parameters need to be considered and collected at the same time. U.S. Patent Publication No. 20180106014 (Horstman) discloses a control system for a work vehicle. More particularly, in paragraph [0038], Horstman's system provides its operator "with an interface display to access and configure embedded software by which one or more control inputs may be programmed to stow only a selected subset of the work implements on the machine." However, Horstman fails to disclose or suggest how to properly coordinate its "work implements" so as to effectively operate its machine. Thus, it would be advantageous to have an improved method and system to address the foregoing needs.

SUMMARY OF THE INVENTION

The present technology is directed to systems and methods for operating a machine. In some embodiments, the machine can be a motor grader or a grading machine having multiple components (e.g., a blade, a moldboard, a snow wing, etc.) coordinating with one another to perform a task (e.g., removing snow from a road surface). The present method includes (i) receiving information regarding material or an object on a surface; and (ii) determining a set of parameters for operating a grading machine. The grading machine is configured to travel on the surface and to move or remove the material or the object on the surface. The set of parameters include, for example, an articulation angle of the grading machine, a moldboard angle (or a circle angle) of the moldboard of the grading machine, and wheel lean for the front wheels of the grading machine. Examples of the articulation angle and the moldboard angle are discussed in detail with reference to FIG. 2A, and the wheel lean is discussed in detail with reference to FIGS. 3A and 3B.

The present method further includes positioning a snow wing of the grading machine based on the set of parameters such that the snow wing and the moldboard can coordinate with each other to effectively complete the task. In some embodiments, the snow wing can be in alignment with the moldboard. In some embodiments, the snow wing can be in parallel to the moldboard. In some embodiment, the snow wing can be positioned to form a specific acute angle (e.g., 10, 15, 30, etc. degrees) with the moldboard. By this arrangement, the present technology enables operators, either experienced or inexperienced, to effectively operate the grading machine.

Another aspect of the present technology is to provide a machine or system that can be autonomously (or partially autonomously) and effectively operated. The machine can include, for example, a processor and a memory communicably coupled to the one processor. The memory can store computer executable instructions, when executed by the processor, to: (i) receive information regarding material on a surface where machine travels on and is configured to move/remove the material on/from the surface; (ii) determine a set of parameters for operating the grading machine, and the set of parameters include an articulation angle of the machine and a moldboard angle of a moldboard of the machine; (iii) position a snow wing of the machine based on the set of parameters such that the snow wing is in alignment with the moldboard; and (iv) operate the machine based on the set of parameters. In some embodiments, the moldboard can also be positioned, along with the snow wing, based on the set of parameters.

BRIEF DESCRIPTION OF THE DRAWINGS

Non-limiting and non-exhaustive examples are described with reference to the following figures.

DETAILED DESCRIPTION

Various aspects of the disclosure are described more fully below with reference to the accompanying drawings, which form a part hereof, and which show specific exemplary aspects. Different aspects of the disclosure may be implemented in many different forms and the scope of protection sought should not be construed as limited to the aspects set forth herein. Rather, these aspects are provided so that this disclosure will be thorough and complete, and will fully convey the scope of the aspects to those skilled in the art. Aspects may be practiced as methods, systems, or devices. Accordingly, aspects may take the form of a hardware implementation, an entirely software implementation, or an implementation combining software and hardware aspects. The following detailed description is, therefore, not to be taken in a limiting sense.

Figure 1:
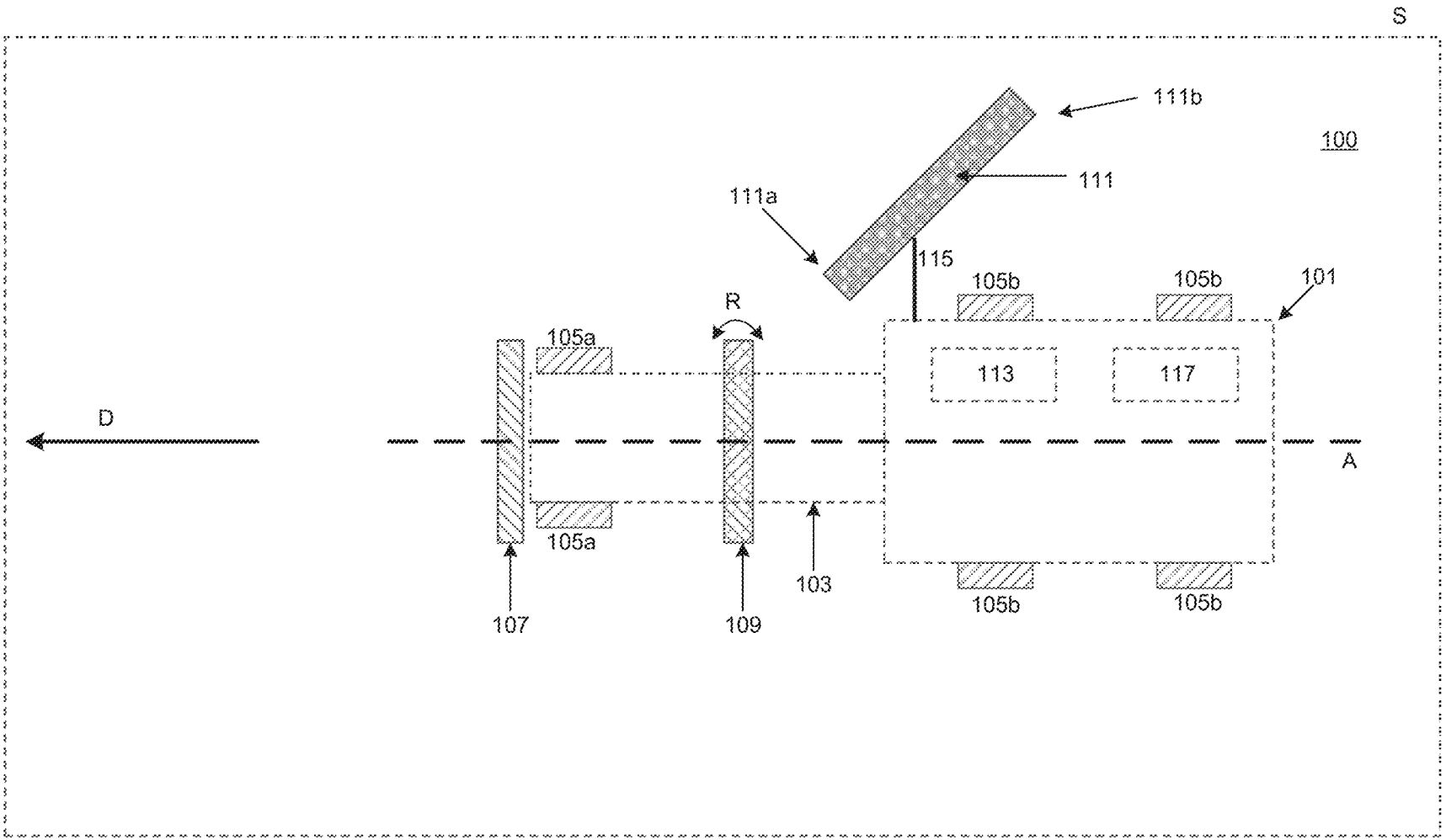
FIG. 1 is a schematic diagram (top view) illustrating a machine in accordance with embodiments of the present technology.

FIG. 1 is a schematic diagram (top view) illustrating a machine 100 in accordance with embodiments of the present technology. As shown, the machine 100 includes a main body 101, a front unit 103 pivotably connected to the main body 101 by a suitable coupling (not shown), multiple wheels 105 (including two front wheels 105*a* and two sets of tandem wheels 105*b*), a front blade 107, a moldboard 109, and a snow wing 111. The machine 100 has a center axis B extending through the main body 101 and a front unit axis BB (shown in FIG. 2A) extending through and the front unit 103, here, the center axis B and the front axis being co-linear. The wheels 105 are configured to move the machine 100 in a moving direction D on a surface S.

As shown in FIG. 1, the front blade 107 is positioned in front of the front unit 103 and is configured to move material or objects along the moving direction D. In some embodiments, the front blade 107 can be optional. In some embodiments, the front blade 107 can be a snow plow, a snow shovel, or other suitable components. The front blade 107 can be moved or rotated by the front unit 103, for example, about a vertical axis (not shown) and/or a horizontal axis (not shown).

The front unit 103 is coupled to the moldboard 109 and is configured to rotate and move the moldboard 109. In some embodiments, the moldboard 109 can be rotated in direction R about a vertical axis (not shown). In some embodiments, the moldboard 109 can be moved horizontally (e.g., in a plane parallel to the surface S) and/or moved vertically (e.g., moving toward or away from the surface S). In some embodiments, the front unit 103 includes a drawbar, a circle drive component, etc.

The snow wing 111 is positioned at one side of the machine 100 and configured to move the objects or material away from the surface S when the machine 100 moves in moving direction D. In some embodiments, the snow wing 111 can have a rectangular shape, a trapezoidal shape, and/or other suitable shapes. The snow wing 111 is coupled to the main body 101 via a connecting bar 115 and can be moved by the connecting bar 115. The snow wing 111 includes a leading edge 111*a* and a trailing edge 111*b*. The leading edge 111*a* is adjacent to the main body 101 of the grading machine 100. The trailing edge 111*b* is further from the main body 101 of the grading machine 100 than the leading edge 111*a*.

A controller (or a processor) 113 can be positioned in the main body 101 and configured to coordinate the operations of the front blade 107, the moldboard 109, and the snow wing 111. In some embodiments, the controller 113 receives instructions from an operator regarding how to operate the front blade 107, the moldboard 109, and the snow wing 111. In some embodiments, one or more sets of "favorite" operational instructions can be stored in a storage device or memory 117 of the machine 100. Each set of operational instructions corresponds to parameters regarding how to operate the front blade 107, the moldboard 109, the snow wing 111, and/or other suitable components of the machine 100 in different situations or scenarios (e.g., "heavy snow," "light snow," "soft road surface," "hard road surface," "inclined road surface," etc.).

For example, a first set of operational instructions can be used to position the moldboard 109 and the snow wing 111 such that these two components are in alignment with each other. As another example, a second set of operational instructions can be used to position the moldboard 109 and the snow wing 111 in parallel. In yet another example, a third set of operational instructions can be used to position the front blade 107 parallel to the moldboard 109 and/or the snow wing 111. In some embodiments, the sets of operational instructions can be customized by the operator. By this arrangement, the operator can operate the machine 100 in various situations in a convenient way.

Figure 2A:
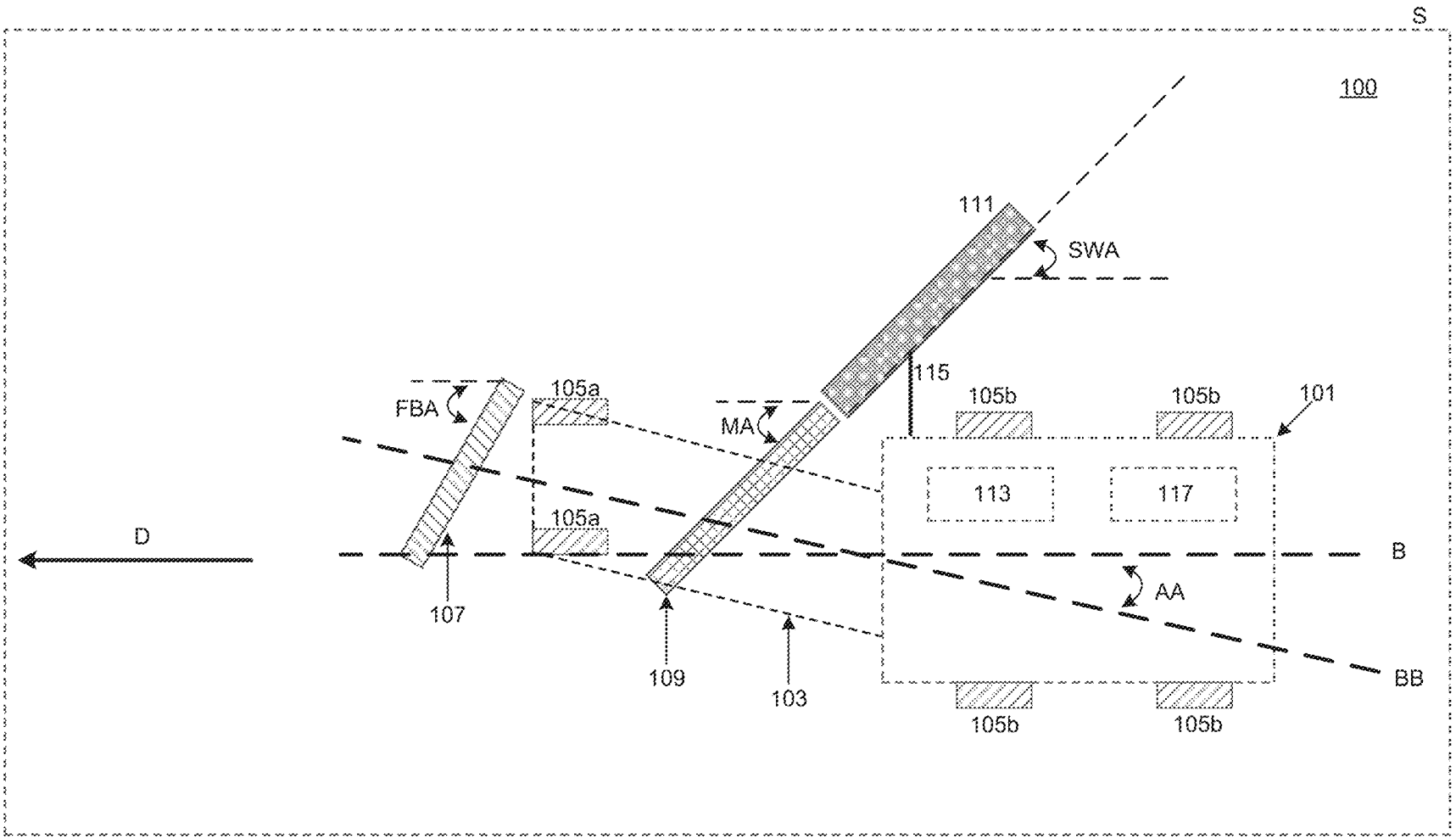
FIG. 2A is a schematic diagram (top view) illustrating operations of a machine in accordance with embodiments of the present technology.

FIG. 2A is a schematic diagram (top view) illustrating operations of the machine 100 in accordance with embodiments of the present technology. As shown in FIG. 2A, the front unit 103 can move the two front wheels 105*a* away from the center axis B such that the front unit 103 now has a shifted axis BB which forms an articulation angle AA with the center axis B. In some embodiments, the articulation angle AA is one of the parameters to be considered in the sets of operational instructions.

As shown in FIG. 2A, the front blade 107 can be moved/rotated to form a front-blade angle FBA with the center axis B. As also shown in FIG. 2A, the moldboard 109 can be moved/rotated to form a moldboard angle MA with the center axis B, and the snow wing 111 can be moved/rotated to form a snow-wing angle SWA with the center axis B. In some embodiments, the foregoing angles FBA, MA and SWA can also be considered as the parameters in the sets of operational instructions.

Figure 2B:
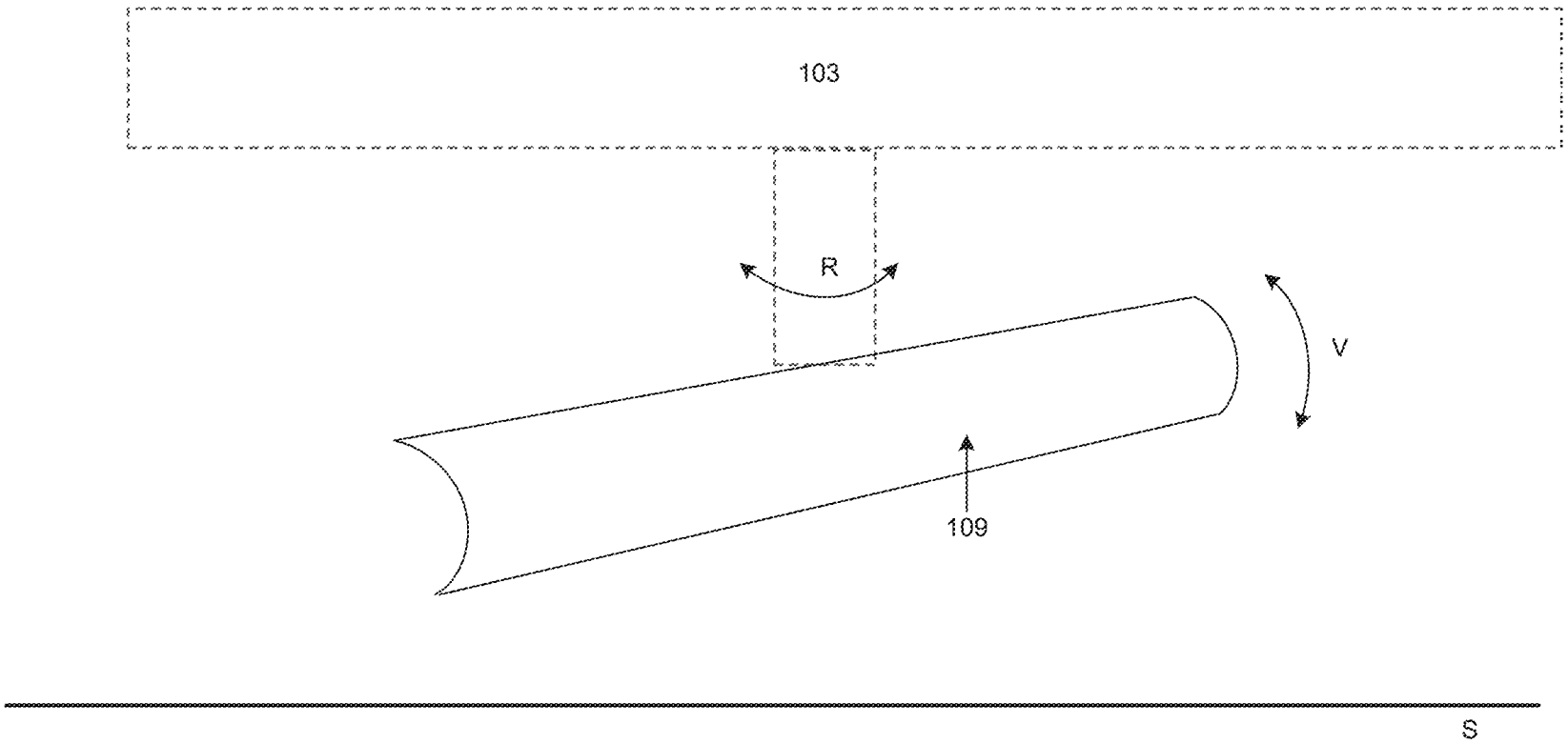
FIG. 2B is a schematic diagram (side view) illustrating operations of a moldboard in accordance with embodiments of the present technology.

In some embodiments, the moldboard 109 can also be rotated/moved vertically. As shown in FIG. 2B, the moldboard 109 can be vertically moved/rotated relative to the surface S (indicated by direction V, by rotating about a horizontal axis which may be parallel to axis BB, in a plane "perpendicular" to the surface S), in additional to the rotation/movement shown in FIG. 1 (indicated by direction R, by rotating about a vertical axis, in a plane "parallel" to the surface S). The vertical and horizontal movement/rotation of the moldboard 109 can also be one of the parameters to be considered in the sets of operational instructions.

Figure 3A:
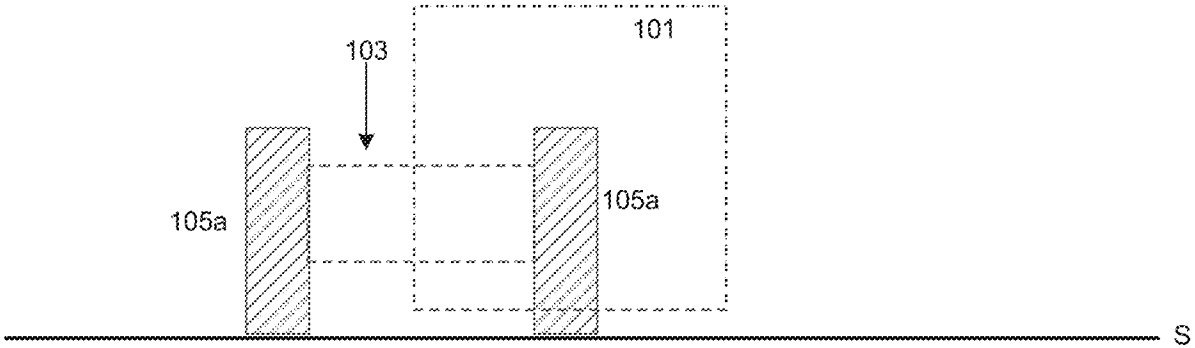
FIGS. 3A and 3B are schematic diagrams (front view) illustrating operations of wheels of a machine in accordance with embodiments of the present technology.
Figure 3B:
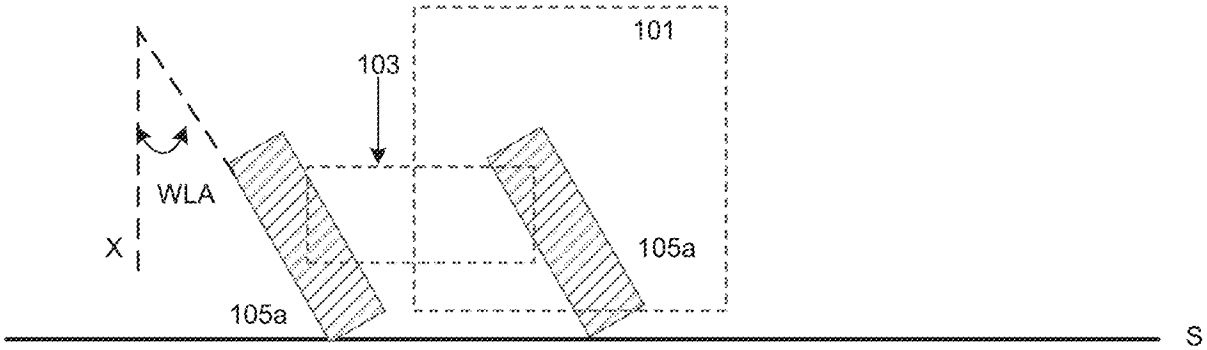

FIGS. 3A and 3B are schematic diagrams (front view) illustrating operations of the front wheels 105*a* of the machine 100 in accordance with embodiments of the present technology. FIG. 3A is a front view showing that the front unit 103 is shifted laterally from the center axis B (see, e.g., FIG. 2A). As shown in FIG. 3B, the two front wheels 105*a* can be tilted to form a wheel-lean angle WLA with an axis X vertical to the surface S. In some embodiments, the wheel-lean angle WLA can also be one of the parameters to be considered in the sets of operational instructions.

Figure 4A:
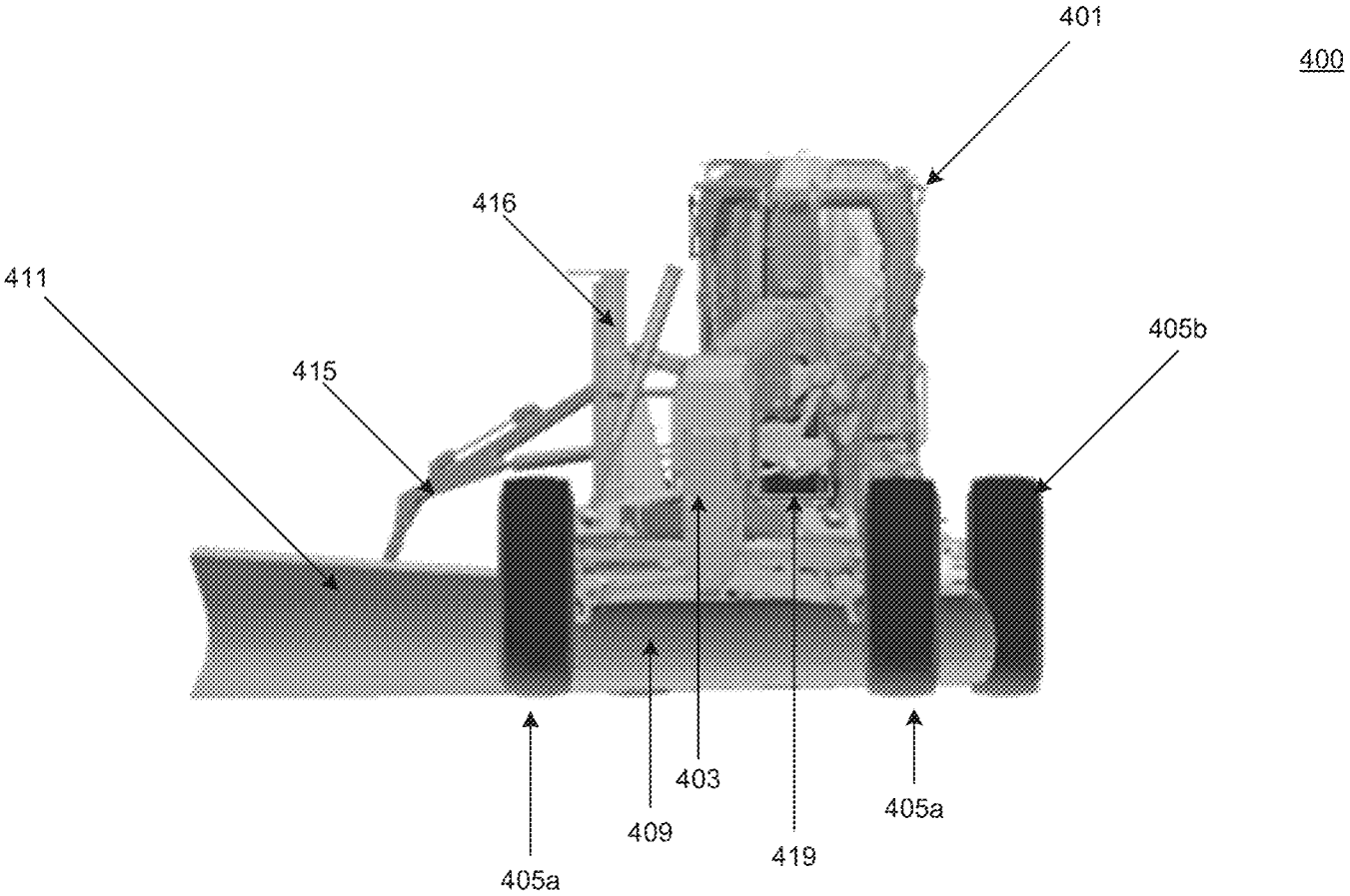
FIG. 4A is a front view illustrating components of a motor grader in accordance with embodiments of the present technology.

FIG. 4A is a front view illustrating components of a motor grader 400 in accordance with embodiments of the present technology. As shown, the motor grader 400 includes a main body 401 with tandem wheels 405*b*, and a front unit 403 pivotably coupled to the main body 401 by a suitable coupling (not shown) and with front wheels 405*a*. The motor grader 400 includes a moldboard 409 coupled to and controlled by a center shaft or a drawbar 419. The drawbar 419 is further coupled to the front unit 403. The motor grader 400 also includes a snow wing 411 coupled to the main body 401 via a connecting bar 415 and a wing mast 416. The connecting bar 415 and the wing mast 416 (e.g., which supports the inner edge of the snow wing 411) are configured to control the movement of the snow wing 411. As shown in FIG. 4A, the snow wing 411 has a trapezoidal shape.

Figure 4B:
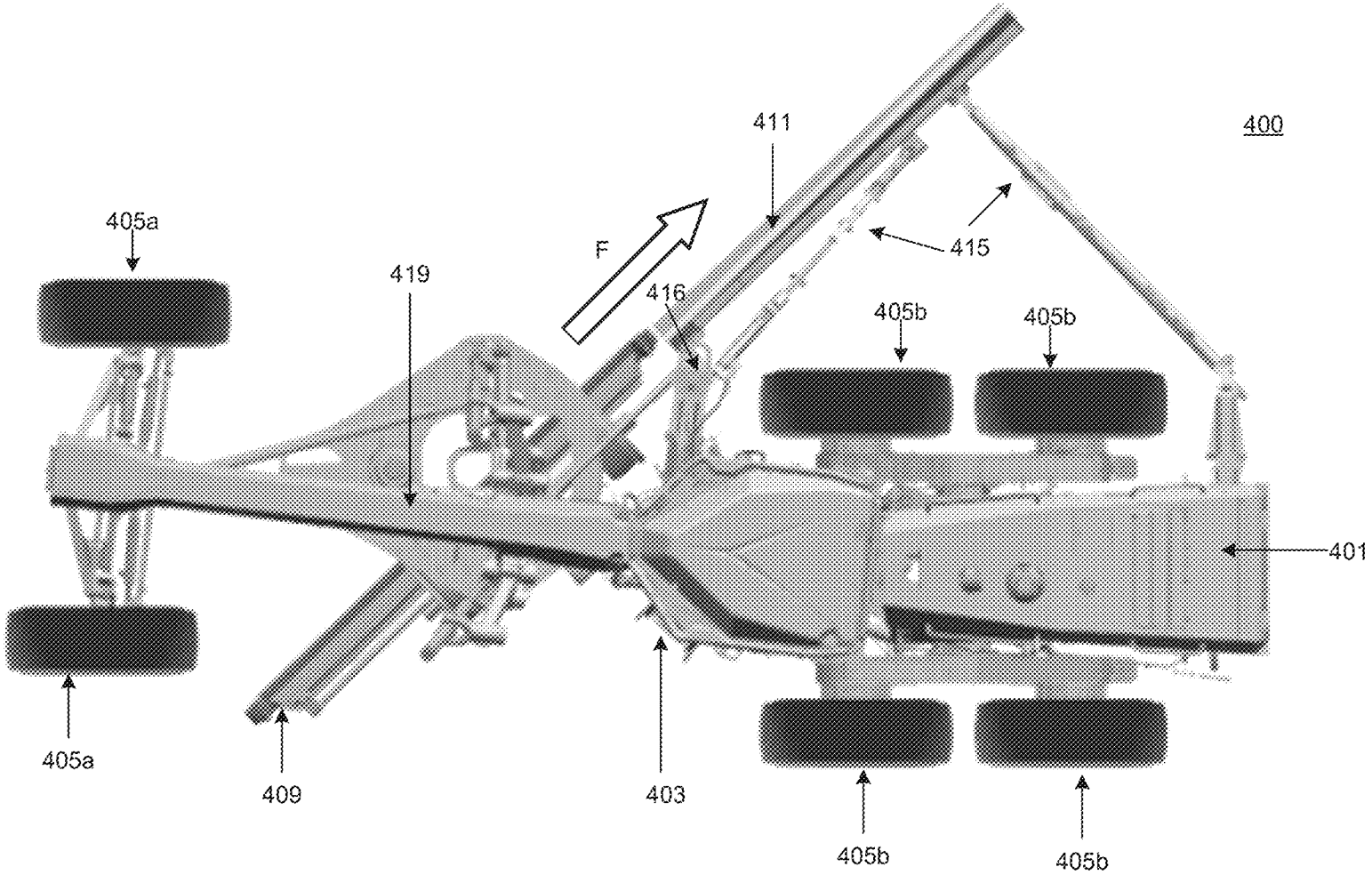
FIG. 4B is a top view illustrating components/operations of a motor grader in accordance with embodiments of the present technology.

FIG. 4B is a top view illustrating components/operations of the motor grader 400 in accordance with embodiments of the present technology. As shown in FIG. 4B, the moldboard 409 and the snow wing 411 are in alignment (e.g., in direction F). By this configuration, objects/material (e.g., snow) on a road surface can be effectively directed away from the motor grader 400 along direction F.

Figure 5A:
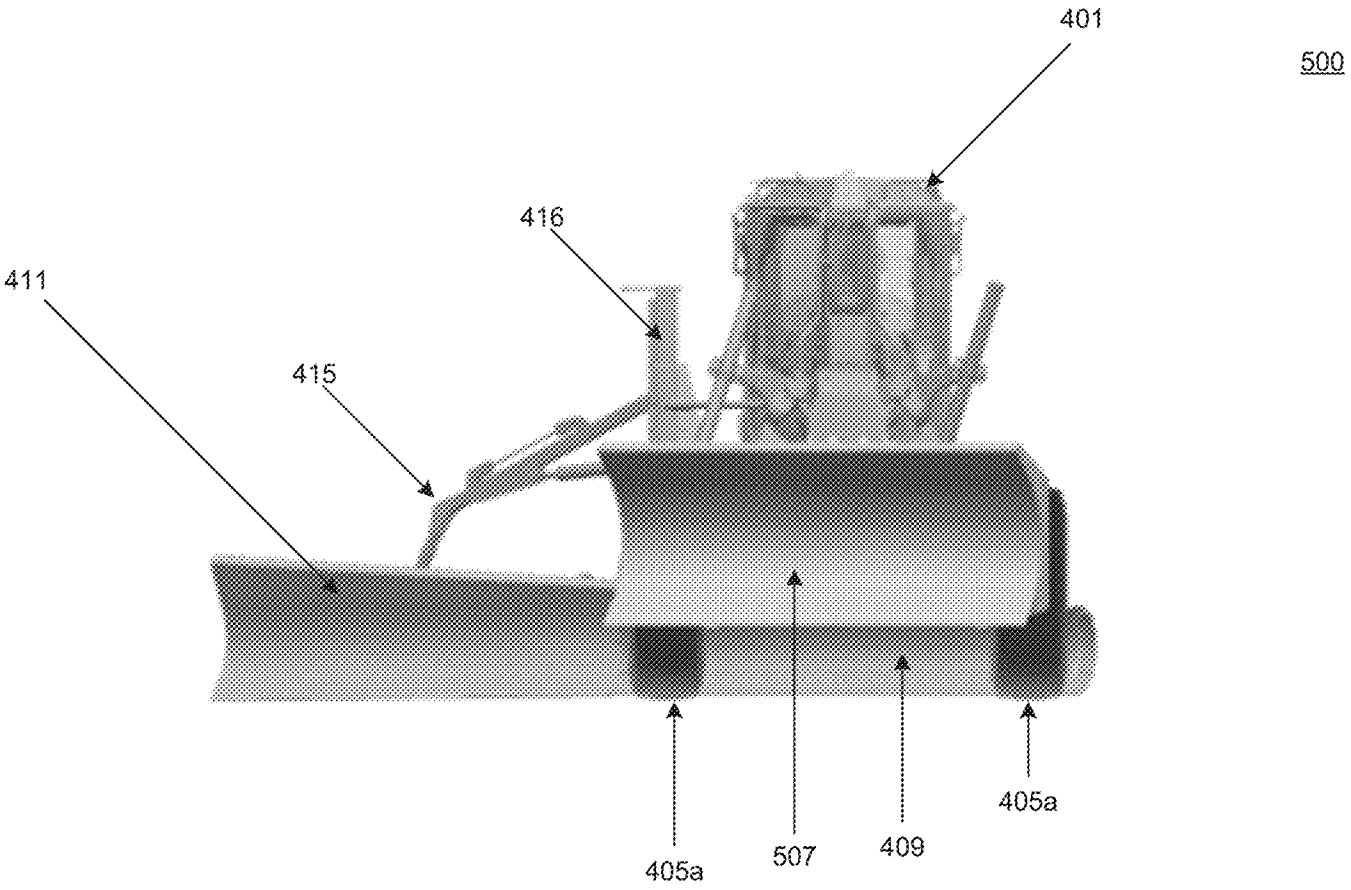
FIG. 5A is a front view illustrating components of a motor grader in accordance with embodiments of the present technology.
Figure 5B:
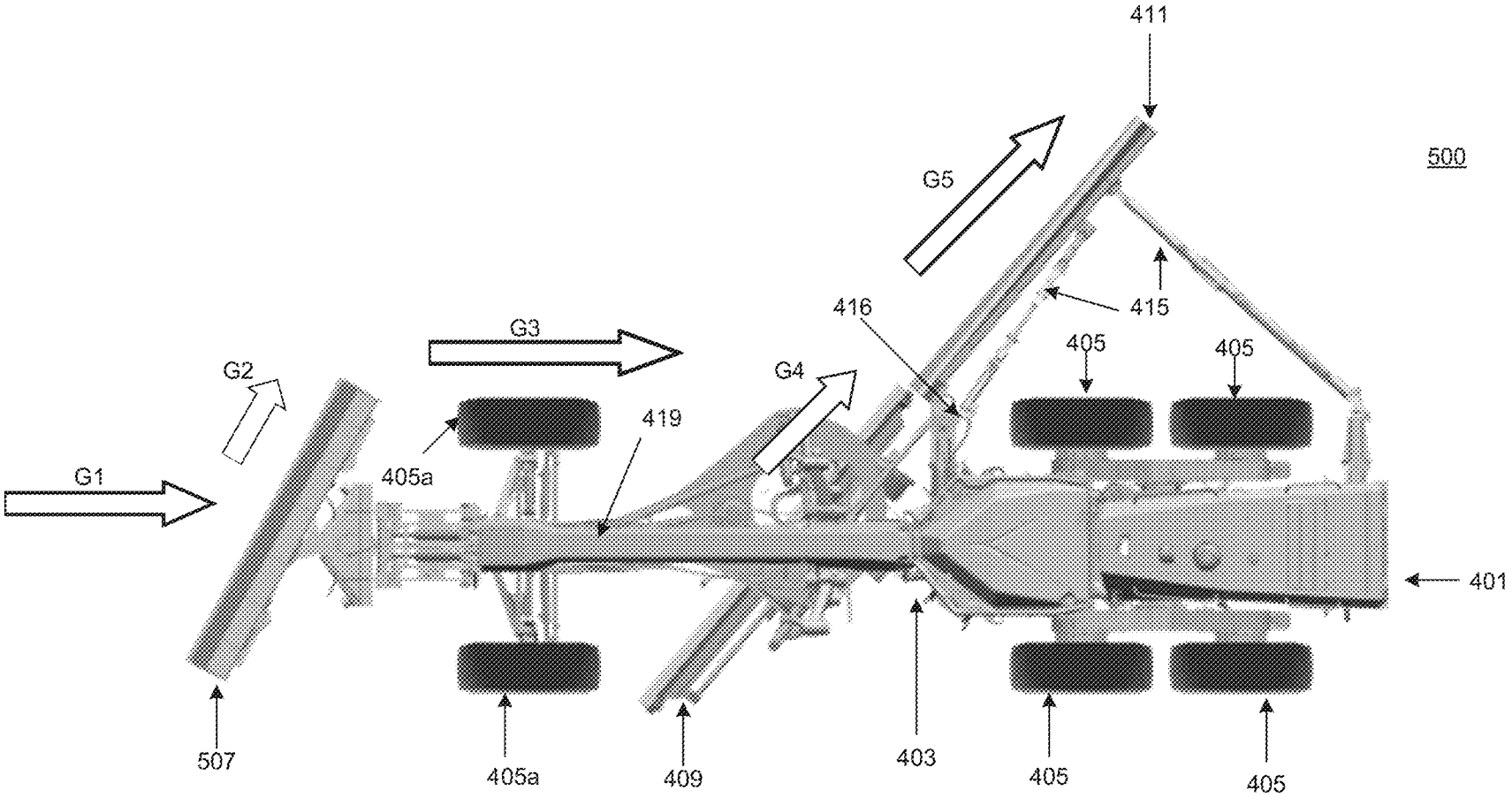
FIG. 5B is a top view illustrating components/operations of a motor grader in accordance with embodiments of the present technology.

FIGS. 5A and 5B are front view and top view illustrating components of a motor grader 500 in accordance with embodiments of the present technology. Referring to both FIGS. 5A and 5B, the motor grader 500 includes a main body 401, a front unit 403 (FIG. 5B) pivotably coupled to the main body 401 by a suitable coupling (not shown) and supported by front wheels 405*a*, a front blade 507, and a moldboard 409 coupled to and controlled by a drawbar 419. The drawbar 419 is further coupled to the front unit 403. The motor grader 500 also includes a snow wing 411 coupled to the main body 401 via a connecting bar 415 and a wing mast 416. The connecting bar 415 and the wing mast 416 are configured to control the movement of the snow wing 411.

As shown in FIG. 5B, the moldboard 409 and the snow wing 411 are in alignment and generally parallel to the front blade 507. By this arrangement, objects/material (e.g., snow) on a road surface can be effectively directed away from the motor grader 400 along directions G1-G5.

Figure 6A:
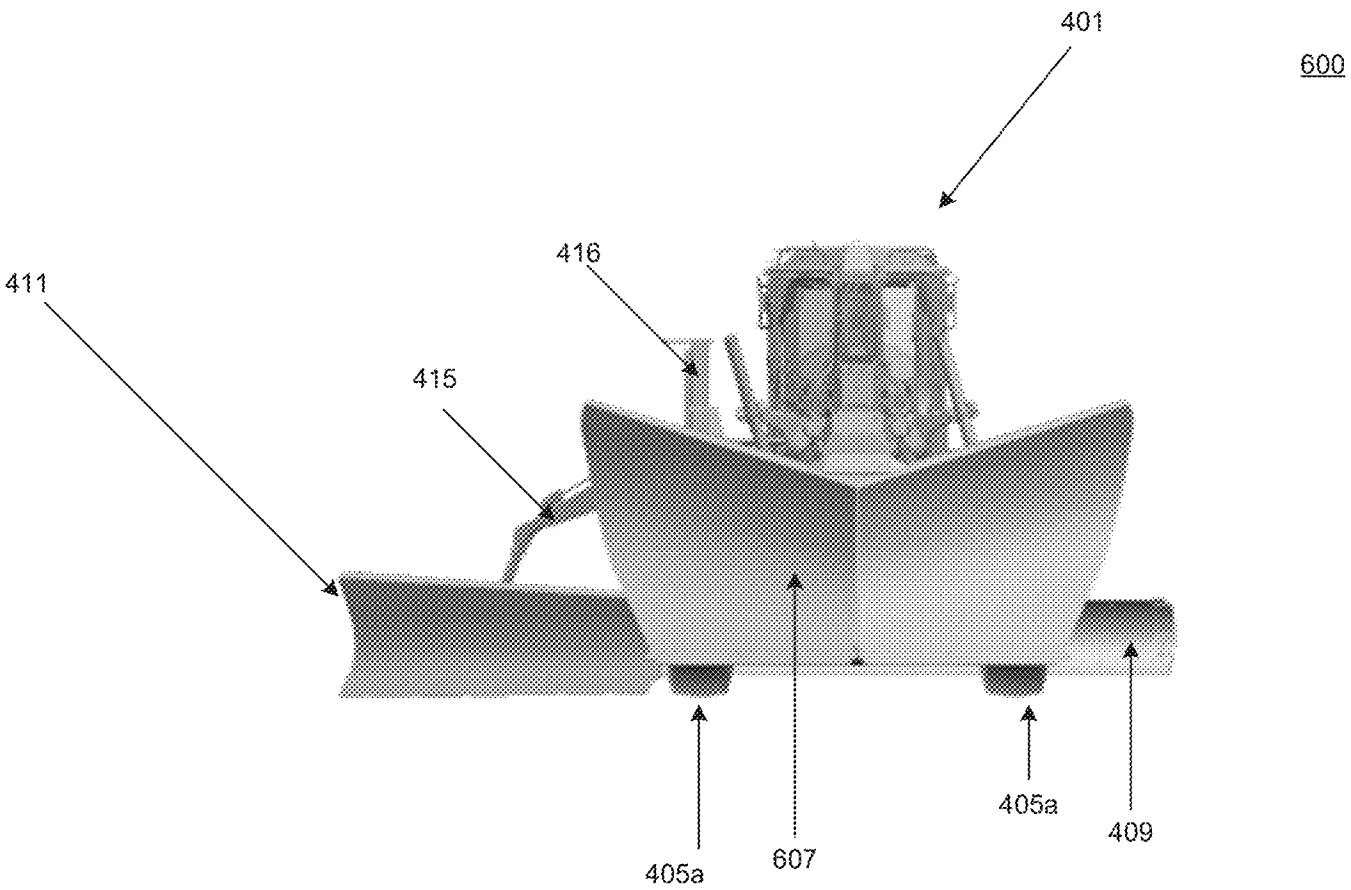
FIG. 6A is a front view illustrating components of a motor grader in accordance with embodiments of the present technology.
Figure 6B:
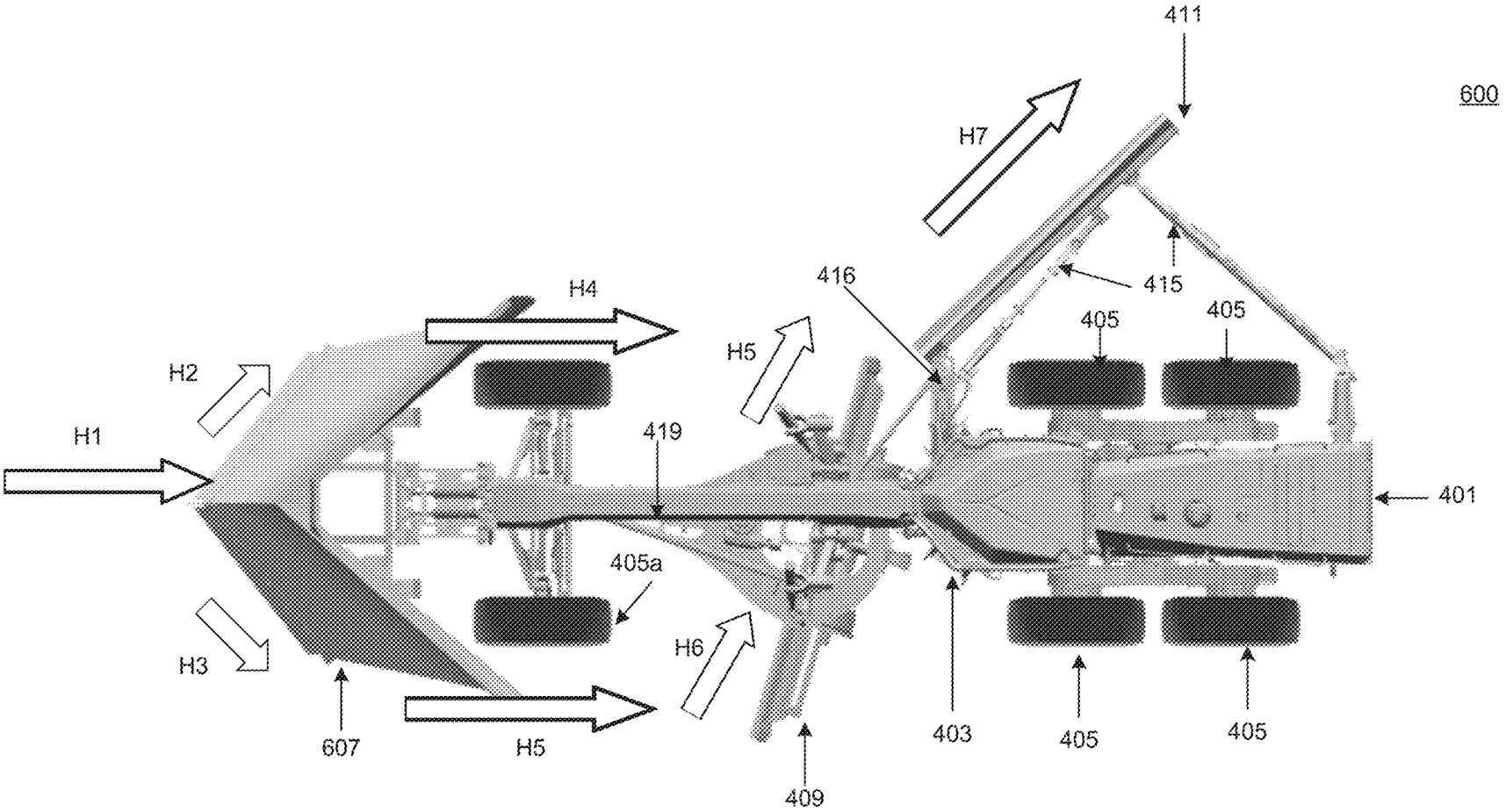
FIG. 6B is a top view illustrating components/operations of a motor grader in accordance with embodiments of the present technology.

FIGS. 6A and 6B are front view and top view illustrating components of a motor grader 600 in accordance with embodiments of the present technology. Referring to both FIGS. 6A and 6B, the motor grader 600 includes a main body 401, a front unit 403 (FIG. 6B) pivotably coupled to the main body 401 by a suitable coupling (not shown) and supported by front wheels 405*a*, a v-shaped front blade 607, and a moldboard 409 coupled to and controlled by a drawbar 419. The drawbar 419 is further coupled to the front unit 403. The motor grader 600 also includes a snow wing 411 coupled to the main body 401 via a connecting bar 415 and a wing mast 416. The connecting bar 415 and the wing mast 416 are configured to control the movement of the snow wing 411.

In the illustrated embodiment in FIG. 6B, the moldboard 409 and the snow wing 411 are positioned to form an obtuse angle (such that an extension axis of the moldboard 409 can form an acute angle with the snow wing 411). The snow wing 411 is positioned (e.g., direction H7) generally parallel to a portion of the v-shaped front blade 607 (e.g., direction H2). In some embodiments, the moldboard 409 can be shifted to the left (i.e., the side opposite to the snow wing 411) to capture material thrown to the left side by the v-shaped front blade 607 and to feed that material to the snow wing 411. By this arrangement, objects/material (e.g., snow) on a road surface can be effectively directed away from the motor grader 600 along directions H1-H7.

Figure 7A:
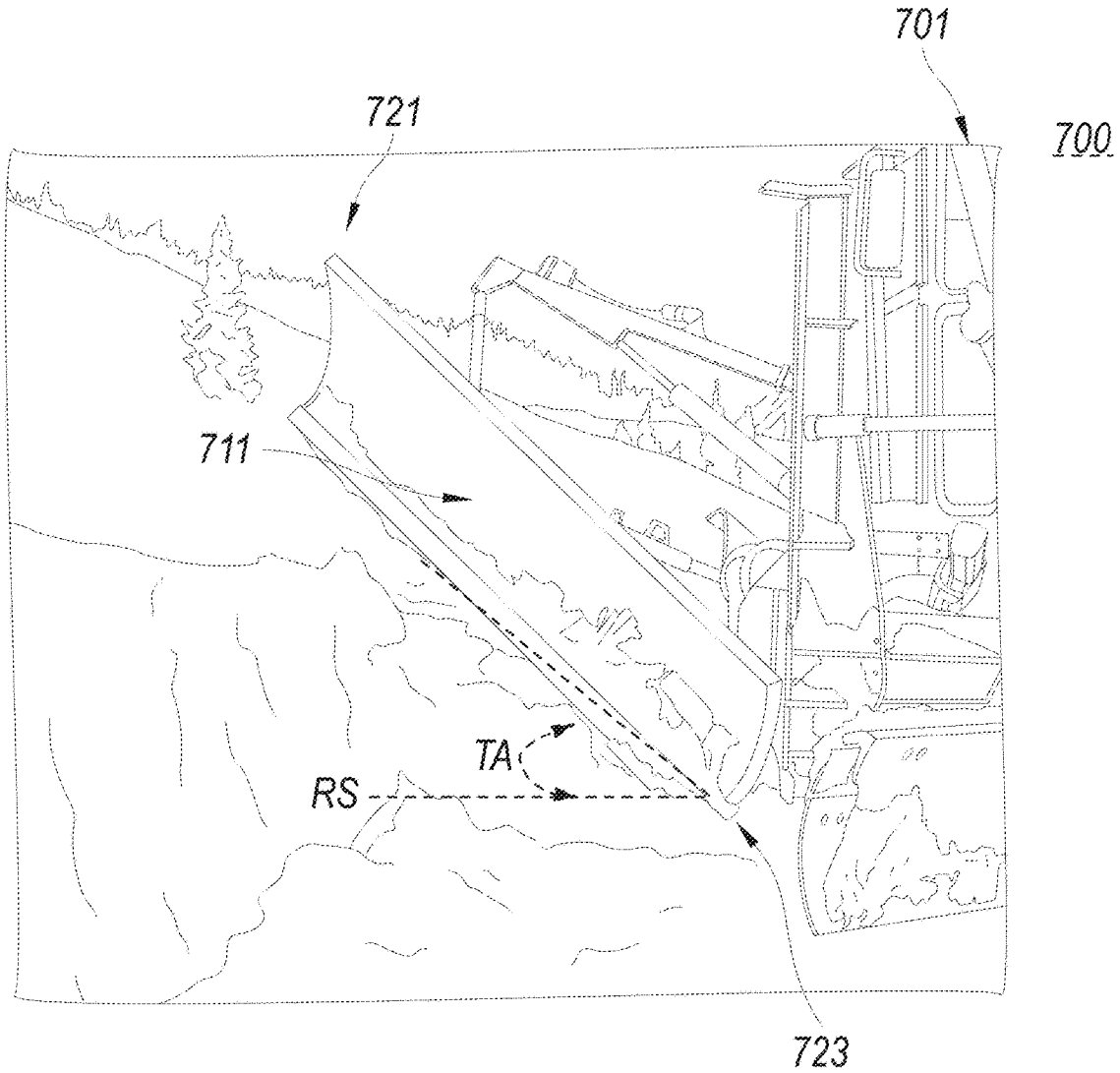
FIG. 7A is a front view illustrating operations of a snow wing of a motor grader in accordance with embodiments of the present technology.
Figure 7B:
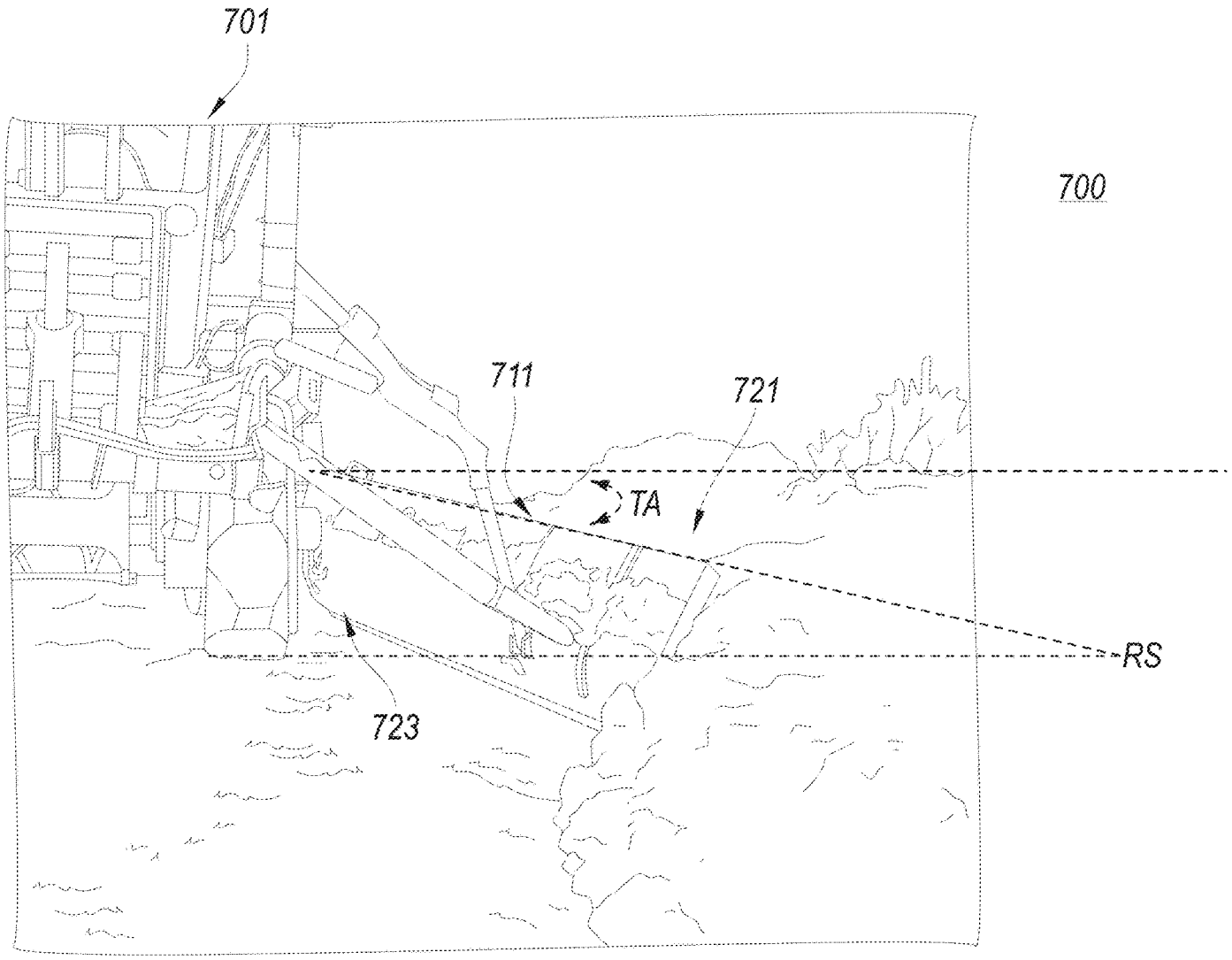
FIG. 7B is a rear view illustrating operations of a snow wing of a motor grader in accordance with embodiments of the present technology.

FIG. 7A is a schematic diagram (front view) illustrating operations of a snow wing 711 of a motor grader 700 in accordance with embodiments of the present technology. The snow wing 711 has a heel portion 721 away from a main body 701 and a toe portion 723 adjacent to the main body 701. The heel portion 721 can be upwardly positioned away from a road surface RS such that the snow wing 711 forms a tilt angle TA with the road surface RS. FIG. 7B is a rear view illustrating operations of the snow wing 711 of the motor grader 700. As shown, the heel portion 721 can be downwardly positioned away from the road surface RS. The tilt angle TA can also be one of the parameters to be considered in the sets of operational instructions discussed above. In some embodiments, the tilt angle TA can an angle between a lower edge of the snow wing 711 and the road surface RS (e.g., FIG. 7A). In some embodiments, the tilt angle TA can be an angle between an upper edge of the snow wing 711 and the road surface RS (e.g., FIG. 7B). In other embodiments, the tilt angle TA can as an angle between a center axis (e.g., in the middle of the upper edge and the lower edge) of the snow wing 711 and the road surface RS.

Figure 8A:
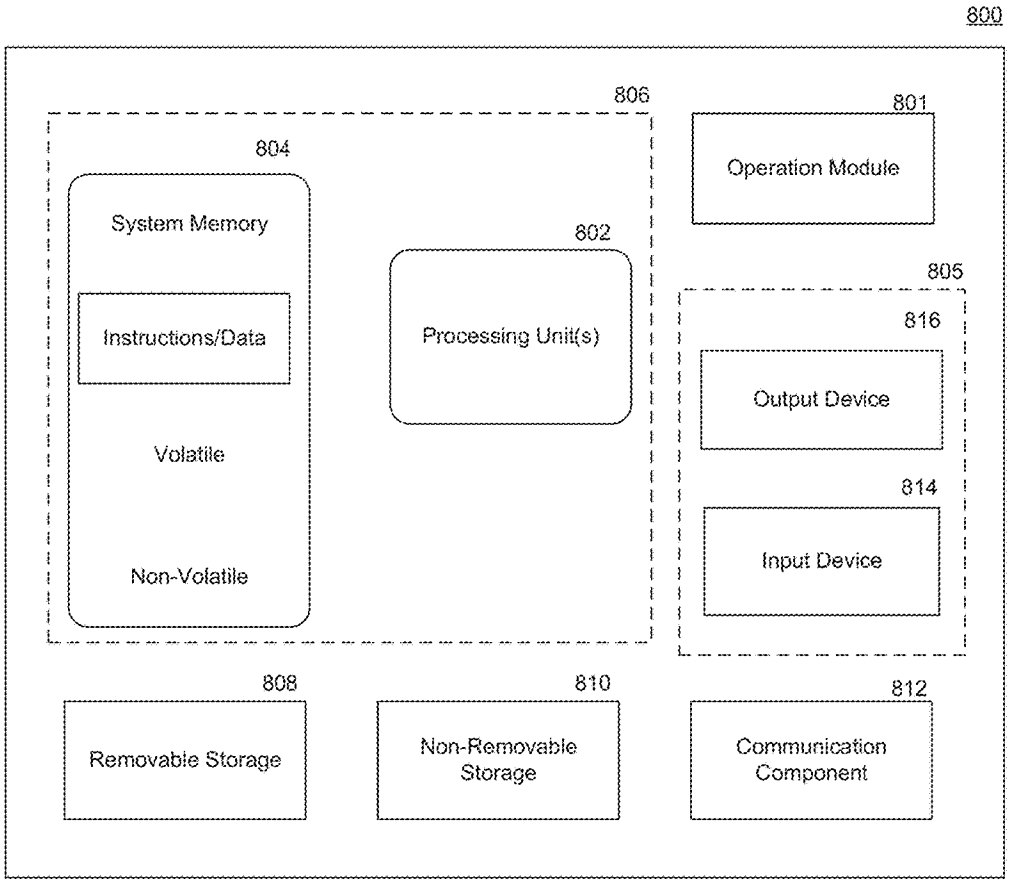
FIG. 8A is a schematic diagram illustrating components in a computing device configured to interact with a machine in accordance with embodiments of the present technology.

FIG. 8A is a schematic diagram illustrating components in a computing device 800 in accordance with embodiments of the present technology. The computing device 800 can be used to implement methods (e.g., FIG. 9) discussed herein. Note the computing device 800 is only an example of a suitable computing device and is not intended to suggest any limitation as to the scope of use or functionality. Other well-known computing systems, environments, and/or configurations that may be suitable for use include, but are not limited to, personal computers (PCs), server computers, hand-held or laptop devices, multiprocessor systems, microprocessor-based systems, programmable consumer electronics such as smart phones, network PCs, minicomputers, mainframe computers, distributed computing environments that include any of the above systems or devices, and the like.

In its most basic configuration, the computing device 800 includes at least one processing unit 802 and a memory 804. Depending on the exact configuration and the type of computing device, the memory 804 may be volatile (such as a random-access memory or RAM), non-volatile (such as a read-only memory or ROM, a flash memory, etc.), or some combination of the two. A basic configuration is illustrated in FIG. 8A by dashed line 806. Further, the computing device 800 may also include storage devices (a removable storage 808 and/or a non-removable storage 810) including, but not limited to, magnetic or optical disks or tape. Similarly, the computing device 800 can have an input device 814 such as keyboard, mouse, pen, voice input, etc. and/or an output device 816 such as a display, speakers, printer, etc. Also included in the computing device 800 can be one or more communication components 812, such as components for connecting via a local area network (LAN), a wide area network (WAN), point to point, any other suitable interface, etc.

The computing device 800 can include an operation module 801 configured to implement methods for operating the machines based on one or more sets of parameters corresponding to components of the machines in various situations and scenarios. For example, the operation module 801 can be configured to operate the machines 100, 400, 500, 600, and 700 based on "favorite" configurations of the snow wing, the moldboard, and/or the front blade discussed herein. In some embodiments, the operation module 801 can be in form of instructions, software, firmware, as well as a tangible device.

In some embodiments, the output device 816 and the input device 814 can be implemented as the integrated user interface 805. The integrated user interface 805 is configured to visually present information associated with inputs and outputs of the machines.

The computing device 800 includes at least some form of computer readable media. The computer readable media can be any available media that can be accessed by the processing unit 802. By way of example, the computer readable media can include computer storage media and communication media. The computer storage media can include volatile and nonvolatile, removable and non-removable media (e.g., removable storage 808 and non-removable storage 810) implemented in any method or technology for storage of information such as computer readable instructions, data structures, program modules or other data. The computer storage media can include, an RAM, an ROM, an electrically erasable programmable read-only memory (EEPROM), a flash memory or other suitable memory, a CD-ROM, digital versatile disks (DVD) or other optical storage, magnetic cassettes, magnetic tape, magnetic disk storage or other magnetic storage devices, or any other tangible medium which can be used to store the desired information.

The computing device 800 includes communication media or component 812, including non-transitory computer readable instructions, data structures, program modules, or other data. The computer readable instructions can be transported in a modulated data signal such as a carrier wave or other transport mechanism and includes any information delivery media. The term "modulated data signal" means a signal that has one or more of its characteristics set or changed in such a manner as to encode information in the signal. By way of example, and not limitation, the communication media can include wired media such as a wired network or direct-wired connection, and wireless media such as acoustic, radio frequency (RF), infrared and other wireless media. Combinations of the any of the above should also be included within the scope of the computer readable media.

The computing device 800 may be a single computer operating in a networked environment using logical connections to one or more remote computers. The remote computer may be a personal computer, a server, a router, a network PC, a peer device or other common network node, and typically includes many or all of the elements described above as well as others not so mentioned. The logical connections can include any method supported by available communications media. Such networking environments are commonplace in offices, enterprise-wide computer networks, intranets and the Internet.

Figure 8B:
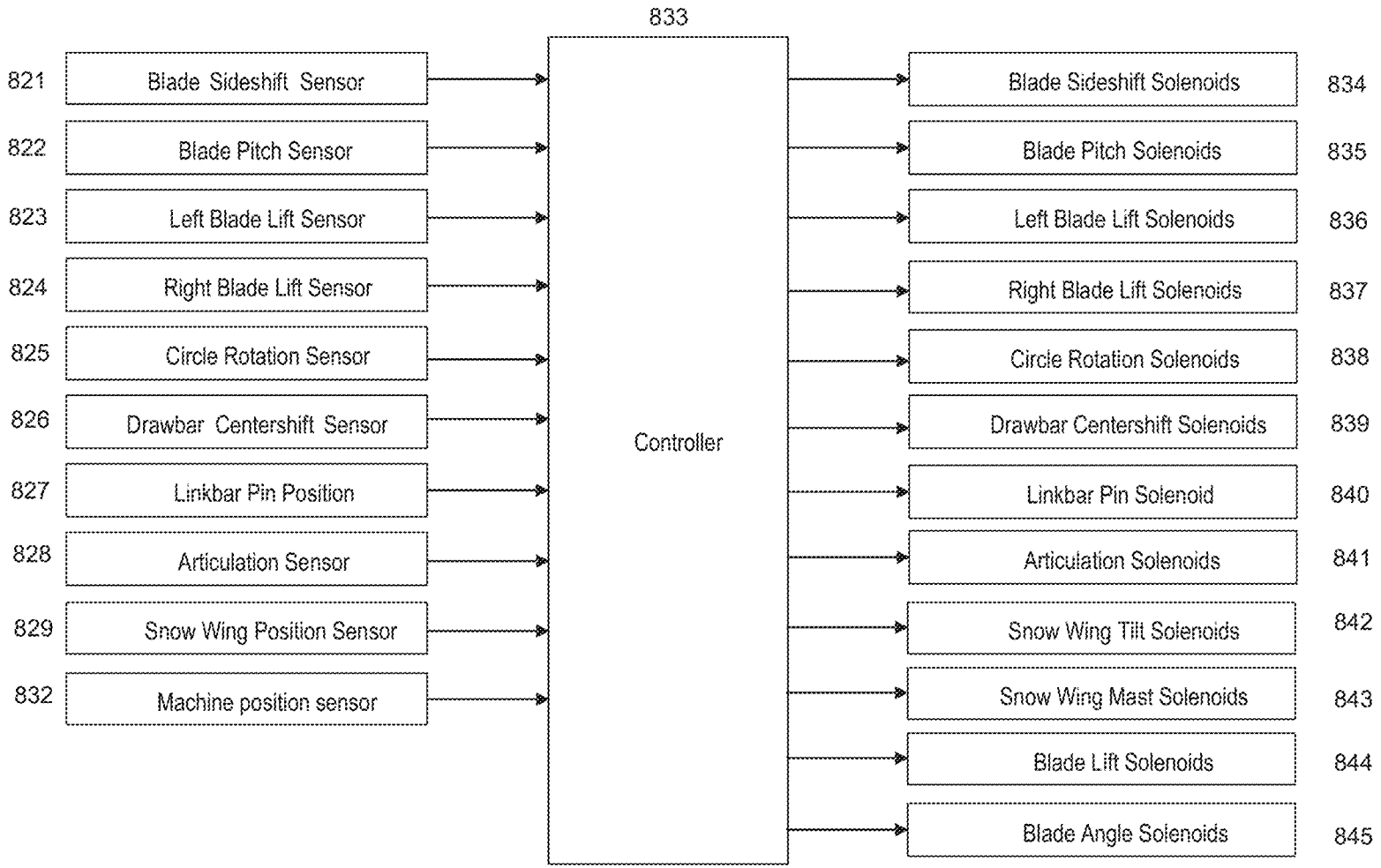
FIG. 8B is a schematic diagram illustrating components of a machine in accordance with embodiments of the present technology.

FIG. 8B is a schematic diagram illustrating components of a machine in accordance with embodiments of the present technology. The machine can include (i) a set of sensors configured to measure statuses of the components of the machine, (ii) a controller 833 configured to receive the measurements of the sensors, and (iii) a set of operation components configured to operate the components of the machine as instructed by the controller 833.

These sensors can include a blade side-shift sensor 821, a blade pitch sensor 822, a left blade lift sensor 823, a right blade lift sensor 824, a circle rotation sensor 825, a drawbar center-shift sensor 826, a link-bar pin (position) sensor 827, an articulation sensor 828, a snow wing position sensor 829, and a machine position sensor 832. The blade side-shift sensor 821 is configured to measure a side shift or movement of a moldboard (e.g., the moldboard 109 or 409) or a blade (e.g., the blade 107, 507, or 607). The blade pitch sensor 822 is configured to measure a pitch or steepness of a slope of the moldboard or the blade. The left and right blade lift sensors 823, 824 are configured to measure a horizontal level of the moldboard or the blade. The circle rotation sensor 825 is configured to measure a rotation of the moldboard.

The drawbar center-shift sensor 826 is configured to measure movement/rotation of the moldboard (see, e.g., FIG. 2B). The link-bar pin (position) sensor 827 is configured to measure the position of a link bar, which can be used to move components such as the blade, and/or other suitable components of the machine. The articulation sensor 828 is configured to measure an articulation angle of the machine (see, e.g., FIG. 2A). The snow wing position sensor 829 is configured to measure a position of the snow wing. The machine position sensor 832 is configured to measure parameters relating to the position of the machine, such as the machine's pitch, yaw, roll, etc.

The controller 833 can receive the measurements from the sensors 821-832 and instruct the corresponding operation components so as to operate the machine. The operation components can include a set of solenoids, such as a blade side-shift solenoid 834, a blade pitch solenoid 835, a left blade lift solenoid 836, a right blade lift solenoid 837, a circle rotation solenoid 838, a drawbar center-shift solenoid 839, a link-bar pin solenoid 840, an articulation solenoid 841, a snow wing tilt solenoid 842, a snow wing mast solenoid 843, a front blade lift solenoid 844, and a front blade angle solenoid 845. The blade side-shift solenoid 834 is configured to move or shift the blade to a side of the machine. The blade pitch solenoid 835 is configured to adjust the pitch of the blade. The left and right blade lift solenoid 836, 837 are configured to lift the blade at different sides.

The circle rotation solenoid 838 is configured to (horizontally) rotate the moldboard. The drawbar center-shift solenoid 839 is configured to move and/or (vertically) rotate the moldboard. The link-bar pin solenoid 840 is configured to lock and unlock the link bar. The articulation solenoid 841 is configured to adjust the articulation angle of the machine. The snow wing tilt solenoid 842 and the snow wing mast solenoid 843 are configured to adjust the position of the snow wing. The blade lift solenoid 844 and the blade angle solenoid 845 are configured to adjust the position/orientation of the blade.

Figure 9:
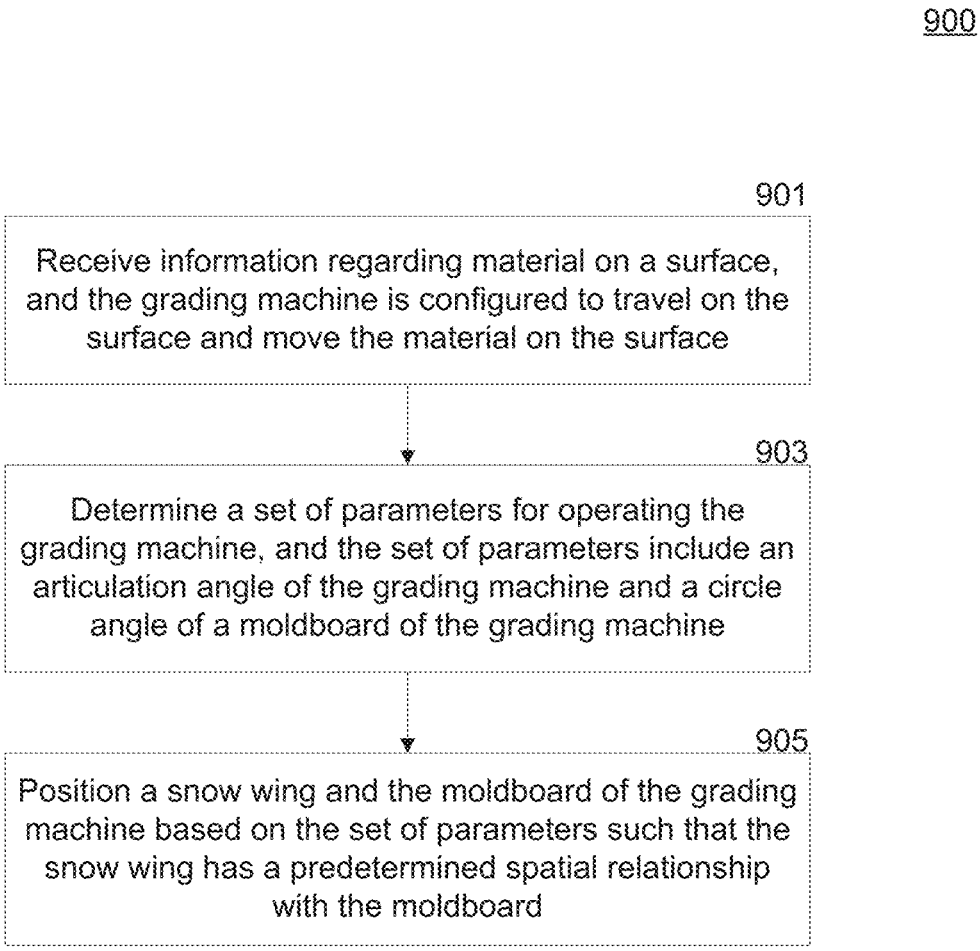
FIG. 9 is a flow diagram showing a method in accordance with embodiments of the present technology.

FIG. 9 is a flow diagram showing a method 900 in accordance with embodiments of the present technology. The method 900 can be implemented to operate a grading machine. The method 900 starts at block 901 by receiving information regarding material on a surface. In some embodiments, the grading machine can be configured to travel on the surface and move the material on the surface. At block 903, the method 900 continues by determining a set of parameters for operating the grading machine. In some embodiments, the set of parameters include an articulation angle of the grading machine and a moldboard angle of a moldboard of the grading machine. In some embodiments, the set of parameters include a wheel lean angle formed between a wheel of the grading machine and the surface.

In some embodiments, the moldboard can be positioned in a center (e.g., a widthwise center or a front-to-back center) of the grading machine and configured to be moved and/or rotated by a drawbar of the grading machine. In some embodiments, the moldboard angle can be formed between a longitudinal axis of the moldboard and a moving direction of the grading machine. In some embodiments, the articulation angle can be caused by a shift of a front unit of the grading machine from a moving direction of the grading machine. In some embodiments, the grading machine includes a front blade coupled to the front unit, and the method 900 can further include positioning the front blade in alignment with the snow wing. In some embodiments, the snow wing forms a snow wing angle with a moving direction of the grading machine. In some cases, the snow wing angle is generally the same as the moldboard angle. In some instances, the snow wing angle is generally the same as the moldboard angle. In some examples, a difference between the snow wing angle and the moldboard angle can be less than 30-10 degrees.

At block 905, the method 900 includes positioning a snow wing and the moldboard of the grading machine based on the set of parameters such that the snow wing has a predetermined spatial relationship with the moldboard. In some embodiments, the predetermined spatial relationship can include that (i) the snow wing is in alignment with the moldboard; (ii) the snow wing is parallel to the moldboard; and/or (iii) the snow wing forms an acute angle with the moldboard.

In some embodiments, the method 900 can further comprise regulating, by a controller of the grading machine, an orientation of the moldboard and/or the snow wing based on the set of parameters. In some embodiments, the set of parameters can be determined based on a predetermined operational configuration chosen by an operator. In some embodiments, the predetermined operational configuration can include (i) aligning the snow wing with the moldboard; (ii) laterally shifting a front wheel of the grading machine so as to form the articulation angle of the grading machine; (iii) leaning a front wheel of the grading machine; and/or (iv) positioning a front blade of the grading machine so as to align with the snow wing and the moldboard. Embodiments of the predetermined operational configuration are discussed with reference to FIG. 4A-5B.

In some embodiments, the predetermined operational configuration can include positioning a v-shaped front blade of the grading machine such that a first portion of the material is directed to the snow wing and a second portion of the material is directed to the moldboard. The predetermined operational configuration can further include positioning the moldboard such that the second portion of the material is further directed to the snow wing. Embodiments of the predetermined operational configuration regarding the v-shaped front blade are discussed with reference to FIGS. 6A and 6B.

In some embodiments, the predetermined operational configuration can include positioning the snow wing parallel to the surface (e.g., so as to from a "bench" on a road surface after removing snow from the road surface). In some embodiments, the predetermined operational configuration can include positioning the snow wing to form a tilt angle relative to the surface. In some embodiments, the tilt angle can be an upward angle (e.g., FIG. 7A) or a downward angle (e.g., FIG. 7B).

In some embodiments, the snow wing can be positioned at a side of the grading machine. The snow wing can have a leading edge and a trailing edge. The leading edge is adjacent to a main body of the grading machine, and the trailing edge is away from the main body of the grading machine. In some embodiments, the moldboard can also be positioned, along with the snow wing, based on the set of parameters.

INDUSTRIAL APPLICABILITY

The systems and methods described herein can operate a grading machine in a work site. The methods enable an operator, experienced or inexperienced, to effectively coordinate and control components (such as a blade, a moldboard, a snow blade, front wheels, etc.) of the grading machine in response to different surface conditions. The present systems and methods can also be implemented to manage multiple industrial machines, vehicles and/or other suitable devices such as surface conditioning machines, etc.

In some embodiments, various use cases can be preprogrammed into the grading machine for operator convenience, saving the operator the trouble of adjusting various components and controlling them throughout the operation. For example, the use cases can include "Ground Level Winging" (e.g., FIGS. 2A, 4A, and 4B), "Clean Up for crumb removal," (e.g., FIGS. 5A and 5B), "Clean up for V-Plow," (e.g., FIGS. 6A and 6B), "Bench" (with the snow wing positioned parallel to a road surface), "Tapered Bank" (e.g., FIG. 7A) and "Down Slope" (e.g., FIG. 7B) By these configurations, the grading machine can be programed to continuously monitor the orientation, position, and/or operation of the blade, the moldboard, the snow wing, the front wheel (e.g., articulation/lean angle) and to adjust them when appropriate throughout the operation to ensure optimal performance.

The above description and drawings are illustrative and are not to be construed as limiting. Numerous specific details are described to provide a thorough understanding of the disclosure. However, in some instances, well-known details are not described in order to avoid obscuring the description. Further, various modifications may be made without deviating from the scope of the embodiments.

Reference in this specification to "one embodiment" or "an embodiment" means that a particular feature, structure, or characteristic described in connection with the embodiment is included in at least one embodiment of the disclosure. The appearances of the phrase "in one embodiment" (or the like) in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

The terms used in this specification generally have their ordinary meanings in the art, within the context of the disclosure, and in the specific context where each term is used. It will be appreciated that the same thing can be said in more than one way. Consequently, alternative language and synonyms may be used for any one or more of the terms discussed herein, and any special significance is not to be placed upon whether or not a term is elaborated or discussed herein. Synonyms for some terms are provided. A recital of one or more synonyms does not exclude the use of other synonyms. The use of examples anywhere in this specification, including examples of any term discussed herein, is illustrative only and is not intended to further limit the scope and meaning of the disclosure or of any exemplified term. Likewise, the claims are not to be limited to various embodiments given in this specification. Unless otherwise defined, all technical and scientific terms used herein have the same meaning as commonly understood by one of ordinary skill in the art to which this disclosure pertains. In the case of conflict, the present document, including definitions, will control.

As used herein, the term "and/or" when used in the phrase "A and/or B" means "A, or B, or both A and B." A similar manner of interpretation applies to the term "and/or" when used in a list of more than two terms.

The above detailed description of embodiments of the technology are not intended to be exhaustive or to limit the technology to the precise forms disclosed above. Although specific embodiments of, and examples for, the technology are described above for illustrative purposes, various equivalent modifications are possible within the scope of the technology as those skilled in the relevant art will recognize. For example, although steps are presented in a given order, alternative embodiments may perform steps in a different order. The various embodiments described herein may also be combined to provide further embodiments.

From the foregoing, it will be appreciated that specific embodiments of the technology have been described herein for purposes of illustration, but well-known structures and functions have not been shown or described in detail to avoid unnecessarily obscuring the description of the embodiments of the technology. Where the context permits, singular or plural terms may also include the plural or singular term, respectively.

As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description using the singular or plural number may also include the plural or singular number respectively. Additionally, the term "comprising" is used throughout to mean including at least the recited feature(s) such that any greater number of the same feature and/or additional types of other features are not precluded, unless context suggests otherwise. It will also be appreciated that specific embodiments have been described herein for purposes of illustration, but that various modifications may be made without deviating from the technology. Further, while advantages associated with some embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein. Any listing of features in the claims should not be construed as a Markush grouping.

The invention claimed is:

1. A method for operating a grading machine, comprising:

receiving information regarding material on a surface, wherein the grading machine is configured to travel on the surface and move the material on the surface;

determining a set of parameters for operating the grading machine, wherein the set of parameters include an articulation angle of the grading machine and a moldboard angle of a moldboard of the grading machine, wherein the articulation angle is formed by a center axis of the grading machine and a shifted axis of the grading machine; and positioning a snow wing from a first position to a second position and the moldboard of the grading machine based on the set of parameters such that the snow wing has a predetermined spatial relationship with the moldboard, wherein the second position is determined at least based on the articulation angle, wherein the snow wing is dynamically positioned relative to the moldboard based on a result of continuous monitoring of the articulation angle during an operation of the snow wing.

2. The method of claim 1, wherein the predetermined spatial relationship includes that the snow wing is in alignment with the moldboard.

3. The method of claim 1, wherein the predetermined spatial relationship includes that the snow wing forms an obtuse angle with the moldboard.

4. The method of claim 1, further comprising regulating, by a controller of the grading machine, an orientation of the moldboard based on the set of parameters.

5. The method of claim 1, further comprising regulating, by a controller of the grading machine, an orientation of the snow wing based on the set of parameters.

6. The method of claim 1, wherein the set of parameters is determined based on a predetermined operational configuration chosen by an operator.

7. The method of claim 6, wherein the predetermined operational configuration includes:

aligning the snow wing at the first position with the moldboard at a third position corresponding to the first position; and aligning the snow wing at the second position with the moldboard at a fourth position corresponding to the second position.

8. The method of claim 7, wherein the predetermined operational configuration includes laterally shifting a front wheel of the grading machine so as to form the articulation angle of the grading machine.

9. The method of claim 7, wherein the predetermined operational configuration includes leaning a front wheel of the grading machine.

10. The method of claim 7, wherein the predetermined operational configuration includes positioning a front blade of the grading machine so as to align with the snow wing and the moldboard.

11. The method of claim 6, wherein the predetermined operational configuration includes positioning a v-shaped front blade of the grading machine such that a first portion of the material is directed to the snow wing and a second portion of the material is directed to the moldboard.

12. The method of claim 11, wherein the predetermined operational configuration includes positioning the moldboard such that the second portion of the material is further directed to the snow wing.

13. The method of claim 6, wherein the predetermined operational configuration includes positioning the snow wing parallel to the surface.

14. The method of claim 6, wherein the predetermined operational configuration includes positioning the snow wing to form a tilt angle relative to the surface.

15. A grading machine comprising:

a processor;

a memory communicably coupled to the one processor, the memory comprising computer executable instructions, when executed by the processor, to:

receive information regarding material on a surface, wherein the grading machine is configured to travel on the surface and move the material on the surface;

determine a set of parameters for operating the grading machine, wherein the set of parameters include an articulation angle of the grading machine and a moldboard angle of a moldboard of the grading machine, wherein the articulation angle is formed by a center axis of the grading machine and a shifted axis of the grading machine;

position a snow wing from a first position to a second position and the moldboard of the grading machine based on the set of parameters such that the snow wing has a predetermined spatial relationship with the moldboard, wherein the second position is determined at least based on the articulation angle, wherein the snow wing is dynamically positioned relative to the moldboard based on a result of continuous monitoring of the articulation angle during an operation of the snow wing; and operate the grading machine based on the set of parameters.

16. The grading machine of claim 15, wherein the set of parameters is determined based on a predetermined operational configuration chosen by an operator, and wherein the predetermined spatial relationship includes that the snow wing is in alignment with the moldboard according to the predetermined operational configuration.

17. The grading machine of claim 16, wherein the computer executable instructions, when executed by the processor, are to regulate an orientation of the moldboard based on the set of parameters.

18. The grading machine of claim 16, wherein the computer executable instructions, when executed by the processor, are to regulate an orientation of the snow wing based on the set of parameters.

19. A method for operating a grading machine, comprising:

receiving information regarding material on a surface, wherein the grading machine is configured to travel on the surface and move the material on the surface;

determining a set of parameters for operating the grading machine, wherein the set of parameters include an articulation angle of the grading machine, a moldboard angle of a moldboard of the grading machine, and a wheel lean angle formed between a wheel of the grading machine and the surface, wherein the articulation angle is formed by a center axis of the grading machine and a shifted axis of the grading machine;

positioning a snow wing from a first position to a second position and the moldboard of the grading machine based on the set of parameters such that the snow wing has a predetermined spatial relationship with the moldboard, wherein the second position is determined at least based on the articulation angle, wherein the snow wing is dynamically positioned relative to the moldboard based on a result of continuous monitoring of the articulation angle during an operation of the snow wing; and operating the grading machine based on the set of parameters.

* * * * *